United States Patent [19]

Tachikawa et al.

[11] Patent Number: 4,621,512

[45] Date of Patent: Nov. 11, 1986

[54] MECHANISM FOR AND METHOD OF SHIFTING CAM MECHANISMS IN A PRESS FOR PRESSING WORKPIECES WITH DEPRESSED PORTIONS

[75] Inventors: Shinziro Tachikawa; Chikao Hada; Isami Maeda, all of Toyota, Japan

[73] Assignee: Toyota Jidosha Kabushiki Kaisha, Toyota, Japan

[21] Appl. No.: 461,948

[22] Filed: Jan. 28, 1983

[30] Foreign Application Priority Data

Jan. 30, 1982 [JP] Japan ..... 57-12024[U]

[51] Int. Cl.[4] ..... B21D 28/22; B21D 28/30

[52] U.S. Cl. ..... 72/325; 72/327; 72/333; 83/194; 83/178; 83/623

[58] Field of Search ..... 72/326-328, 72/332, 333, 334; 83/192-194, 188, 178, 180, 623; 29/159.1

[56] References Cited

U.S. PATENT DOCUMENTS

| | | | |
|---|---|---|---|
| 1,610,982 | 12/1926 | Theberath | 72/334 |
| 1,702,378 | 2/1929 | Booth | 72/334 |
| 1,766,217 | 6/1930 | Booth | 72/334 |
| 1,807,824 | 6/1931 | Booth | 72/334 |
| 1,825,180 | 9/1931 | Copple | 72/356 |
| 1,878,520 | 9/1932 | Hughes | 83/193 |
| 1,920,303 | 8/1933 | Grotnes | 72/327 |
| 2,202,894 | 6/1940 | Bihler | 83/460 |
| 3,053,210 | 9/1962 | Kowalski | 72/327 |

*Primary Examiner*—Daniel C. Crane

*Attorney, Agent, or Firm*—Kenyon & Kenyon

[57] ABSTRACT

Mechanism for and method of shifting cam mechanisms in a press for pressing workpieces with depressed portions comprise a combination of a first single cam mechanism for retracting a die by a distance equal to the depth of a depressed portion of a workpiece and a second single cam mechanism for pressing the workpiece to work the depressed portion. Said single mechanisms are provided between a bottom form and a top form being vertically movable toward and away from said bottom form. Said first single cam mechanism is composed of a pad positioned downwardly of said top form, a pin mounted on and extending downwardly from said pad, a first cam follower mounted on said bottom form and movable in response to depression of said pin, and a second cam follower mounted on said bottom form. Said second single cam mechanism has a punch for punching the depressed portion of the workpiece and is composed of a fixed cam mounted on the top form, and a third cam follower mounted on said bottom form and supporting said punch.

8 Claims, 7 Drawing Figures

MECHANISM FOR AND METHOD OF SHIFTING CAM MECHANISMS IN A PRESS FOR PRESSING WORKPIECES WITH DEPRESSED PORTIONS

BACKGROUND OF THE INVENTION

The present invention relates to a mechanism for and a method of shifting cam mechanisms in a press for pressing workpieces for form depressed portions.

FIG. 1 of the accompanying drawings illustrates a conventional shifting cam mechanism used in a press. The shifting cam mechanism is of a double-cam construction comprising a shifting cam a, a cam follower c with a die b atached thereto, and a cam follower e with a punch d mounted thereon, the cam follower c, e being movable by the wedging action of the shifting cam a.

SUMMARY OF THE INVENTION

According to the present invention, there are provided a mechanism for and a method of shifting cam mechanisms in a press which comprise a combination of single cam mechanisms and are simpler in construction, easier in fabrication and maintenance, and of smaller noise than conventional double-cam mechanisms.

It is a primary object of the present invention to a shifting cam mechanisms in a press comprising a combination of a single cam mechanism for retracting a die by a distance equal to the depth of a depressed portion of a workpiece, and another single cam mechanism for pressing the workpiece to work the depressed portion.

The single cam mechanism for retracting the die has the function of converting vertical motion of a top form of the press into horizontal motion of the die positioned behind the workpiece. The single cam mechanism for pressing the workpiece has the function of converting vertical motion of the top form of the press into horizontal motion of a punch arranged in confronting relation to the die. The former single cam mechanism further comprises a pin inserted through a hole defined in the workpiece for pushing a cam follower, and another cam follower having the die, and the latter single cam mechanism also comprises a fixed cam. With the shifting cam mechanism in the press of the present invention, the cam follower having the die and the fixed cam can be small in size so that the mechanism may be of a reduced transverse dimension. This arrangement allows wedge cams having different directions of shifting movement to be arranged parallel to each other, resulting in greatly reduced outer dimensions of the mechanism. Reduction in the size of the parts contributes to a smaller number of steps required for mechanically working workpieces and a simplified procedure for maintenance. The small-size cams reduce the sound of impact generated on working the workpiece.

Another object of the present invention is to provide a shifting cam mechanism comprising a single cam mechanism for retracting a die by a distance equal to the depth of a depressed portion of a workpiece, and another single cam mechanism for pressing the workpiece to work the depressed portion, the single cam mechanisms being actuatable in synchronizm in response to downward movement of a top form such that the single cam mechanism for retracting the die will become operative slightly after the single cam mechanism for punching the workpiece has started operating when the top form moves upwardly. The time delay between the operations of these cam mechanisms is created by a clearance or play provided by a lost-motion connection disposed between the top form and a pad pushed thereby and comprising a pin movably received in a slot.

Still another object of the present invention is to provide a shifting cam mechanism in a press, comprising a single cam mechanism for retracting a die by a distance equal to the depth of a depressed portion of a workpiece and another single cam mechanism for working the depressed portion of the workpiece, the single cam mechanisms being urged by springs to move in directions opposite to those in which they are moved in response to downward movement of a top form of the press. The spring-loaded single cam mechanisms can respond quickly to the vertical movement of the top form.

A still further object of the present invention is to provide a cam mechanism for holding a workpiece with an elastic pad disposed around a punch and a pad below a top form when pressing a workpiece to work a depressed portion. Such a cam mechanism is effective in increasing the accuracy of pressing operation.

A yet still further object of the present invention is to provide a method of shifting a single cam mechanism for retracting a die away from a workpiece, and another single cam mechanism for punching the workpiece to work a depressed portion.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

The present invention will now be described with reference to FIGS. 2 through 6 which will illustrate preferred embodiments of the present invention.

Figure 1:
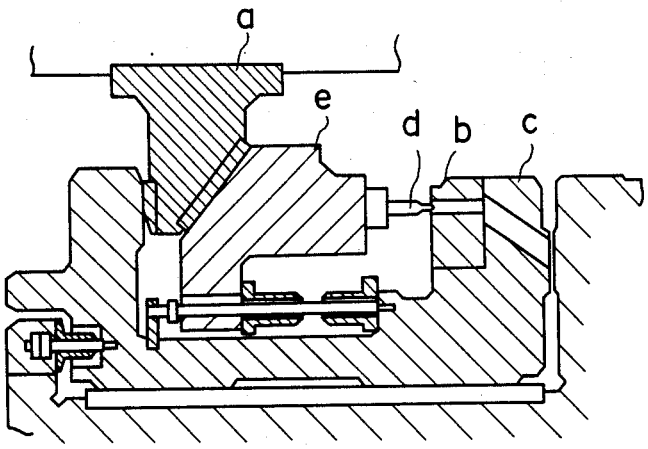
Fig. 1 Prior Art
FIG. 1 is a fragmentary vertical cross-sectional view of a press having a conventional double-cam mechanism.
Figure 2:
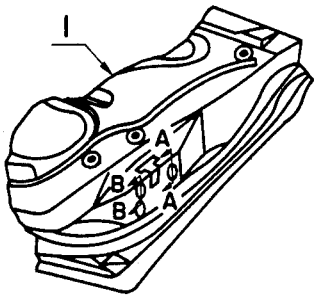
FIG. 2 is a fragmentary perspective view of a workpiece.
Figures 3A, 3B:
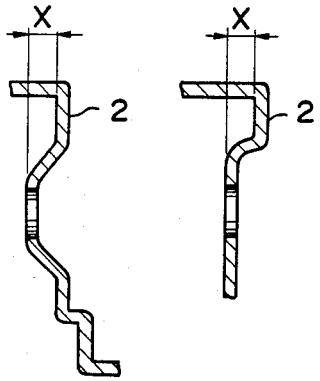
FIGS. 3*a* and 3*b* are enlarged cross-sectional views taken along lines A—A and B—B, respectively, of FIG. 2.

FIG. 2 shows a workpiece in perspective, and FIGS. 3*a* and 3*b* illustrate in enlarged cross section portions of the workpiece, taken along lines A—A and B—B, respectively, of FIG. 2. A workpiece 1 shown in FIG. 2 is composed of panels or plates 2 illustrated in FIGS. 3*a* and 3*b*. The panel shown in FIG. 3*a* has a dish-shaped hole, while the panel shown in FIG. 3*b* has a simple hole. These panels after they have been pressed and punched include a depressed or offset portion that causes the panel to be deformed on removal or prevents it from being removed unless the die is retracted by a distance corresponding to the depth x of the depressed portion of the panel to allow the latter to be lifted for removal. Accordingly, it is necessary that the die be moved back from the punching position by the distnace equal to the depth x of the depressed portion.

A shifting cam mechanism according to the present invention is designed to assist a press in performing the pressing and punching of such a workpiece.

Figure 4:
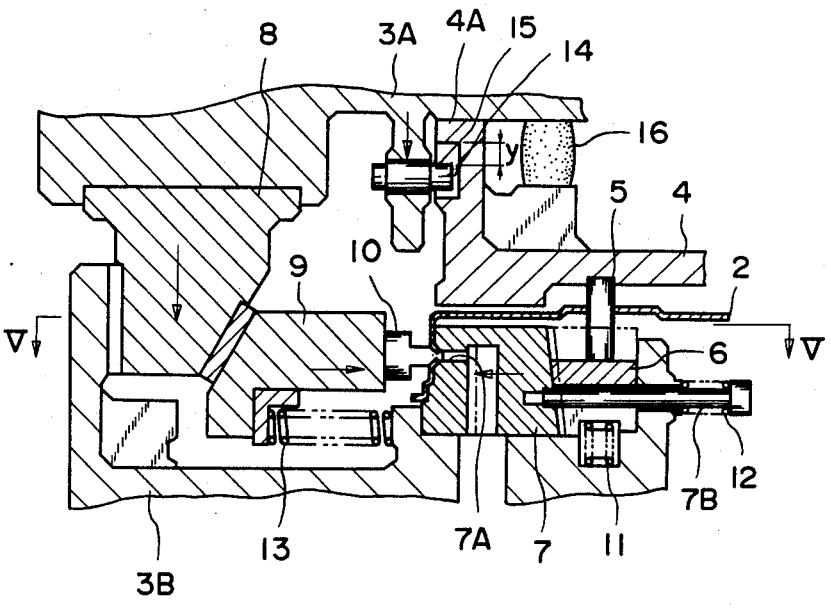
FIG. 4 is a fragmentary vertical cross-sectional views of a press incorporating a shifting cam mechanism according to an embodiment of the present invention.
Figure 5:
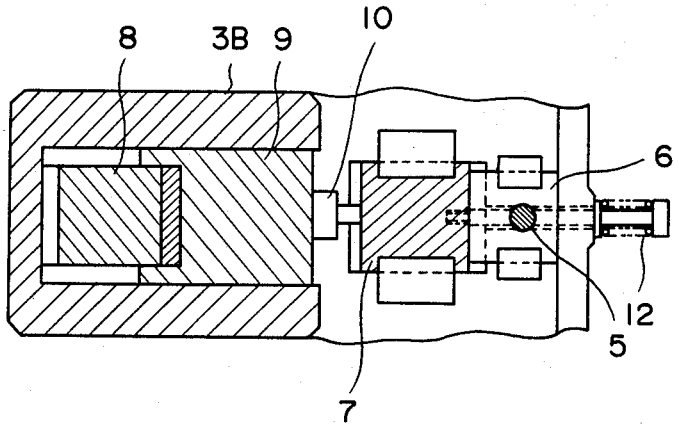
FIG. 5 is a horizontal cross-sectional view taken along line V—V of FIG. 4.

The mechanism of the present invention as shown in FIGS. 4 and 5 will be described hereinbelow.

A press includes a top form 3A and a bottom form 3B, the top form 3A being movable vertically toward and away from the bottom form 3B. The top form 3A is shown in FIG. 4 as being lowered toward the bottom form 3B. A vertically movable pad 4 is positioned below and spaced from the top form 3A and includes an upwardly projecting portion 4A, there being a resilient compressible support 16 made of urethane resin mounted on the pad 4. In the position of FIG. 4, the upper ends of the upwardly projecting portion 4A and the support 16 are held against the top form 3A with the pad 4 being pressed downwardly. When the support 16 is not compressed, it is expanded vertically under its own resiliency and its upper end projects beyond the upper end of the upwardly projecting portion 4A. the top form 3A and the pad 4 are linked together through a lost-motion connection provided by a horizontal pin 15 extending into a vertical slot 14 and vertically movable therein through a clearance or play y. The pin 15 is mounted on the top form 3A, and the slot 14 is defined in the upwardly projecting portion 4A. However, the pin 15 may be mounted on the upwardly projecting portion 4A, and the slot 14 may be defined in the top form 3A. A vertical pin 5 projects downwardly from the pad 4. The pin 5 is arranged to go through a hole in a panel or workpiece 2 into abutment against an upper surface of a first cam follower 6. The first cam follower 6 is guided by the bottom form 3B for vertical movement and is normally biased by a first spring 11 acting between the bottom form 3B and the cam follower 6 so that the cam follower 6 will return to its initial upper position when it is released of a downward push from the pin 5.

A second cam follower 7 having a die 7A is held in slidable contact with the cam surface of the first cam follower 6 and horizontally slidably mounted on the bottom form 3B. The cam follower 7 has a rod 7B extending horizontally rearward through the cam follower 6 and out of the bottom form 3B. A second spring 12 is disposed around a portion of the rod 7B which projects out of the bottom form 3B and acts between the rod 7B and the bottom form 3B. The spring 12 normally biases the cam follower 7 rightward as shown in FIG. 4 so that the cam follower 7 will return to its initial rightward position upon release of pressure by the first cam follower 6. The pad 4, the pin 5, the first cam follower 6, the first and second springs 11, 12, the second cam follower 7, and the rod 7B jointly constitute a first single cam mechanism for retracting the die 7A from the working position on the second cam follower 7 horizontally (as viewed) from the panel 2 by a distance equal to the depth of a depressed or offset portion of the panel 2 as it is pressed and punched.

The top form 3A has a fixed cam 8 dependent therefrom. A third cam follower 9 having a punch 10 is held in slidable contact with the cam surface of the cam 8 and mounted on the bottom from 3B for horizontal slidable movement. The third cam follower 9 is normally biased leftward as shown by a third spring 13 acting between the cam follower 9 and the bottom form 3B for returning movement to an initial leftward position in response to release of the downward push by the fixed cam 8. The fixed cam 8, the third cam follower 9, and the third spring 13 jointly constitute a single cam mechanism for enabling the punch 10 to move from a retracted position to a working position to punch the panel 2 in the depressed portion thereof.

In operation, the top form 3A is lowered to cause the pin 5 on the pad 4 to depress the first cam follower 6 for thereby wedging the second cam follower 7 laterally to the left into intimate contact with the panel 2. During this time, the support 16 is compressed. After the top form 3A abuts the projecting portion 4A, the third cam follower 9 is then wedged horizontally to the right by the lowering fixed cam 8 to enable the punch 10 to work the depressed portion of the panel 2 in coaction with the second cam follower 7. After the panel 2 has been punched, the top form 3A is lifted and the pin 15 and the fixed cam 8 are lifted together therewith at the same time. As the fixed cam 8 is moved upwardly, the third cam follower 9 is allowed back to the left under the resiliency of the third spring 13 until the punch 10 is withdrawn clear out of the punched hole in the panel 2. After the pin 15 has traversed the interval y in the slot 14 on upward movement of the top form 3A, the pad 4 and the pin 5 thereon start being raised, whereupon the first cam follower 6 is elevated under the force of the first spring 11. The second cam follower 7 is now permitted to return to the right under the force of the second spring 12 until the die on the second cam follower 7 is retracted away from the panel 2 by a distnce equal to the depth of the depressed portion of the panel 2.

Figure 6:
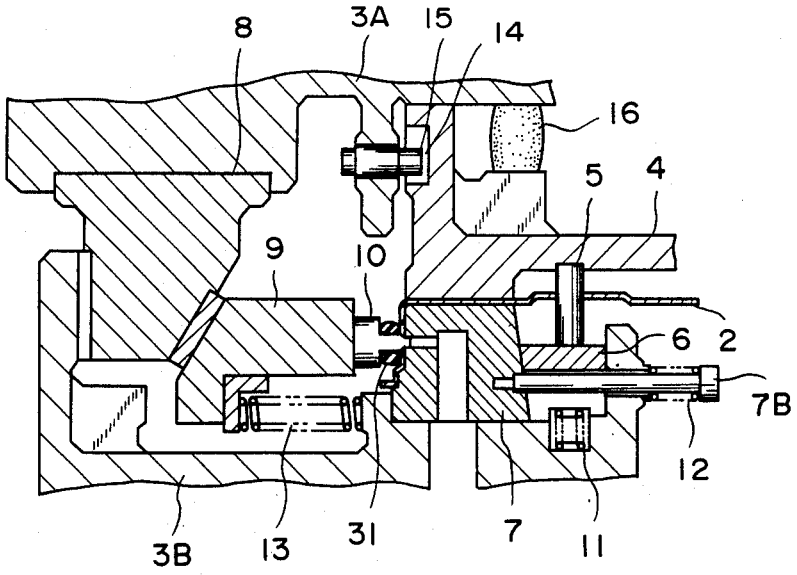
FIG. 6 is a fragmentary vertical cross-sectional view of a press incorporating a shifting cam mechanism according to another embodiment of the present invention.

FIG. 6 shows a shifting cam mechanism according to another embodiment of the present invention. Identical or like parts in FIG. 6 are denoted by identical or like reference characters shown in FIG. 4, and will not be described in detail.

The shifting cam mechanism of FIG. 6 differs from the shifting cam mechanism shown in FIGS. 4 and 5 in that the punch 10 has on its distal end portion a pad 31 made of an elastic material such as rubber for holding a portion of a workpiece which is to be punched, and the workpiece is clamped between the cam follower 7 and the pad 4.

With the embodiment of FIG. 6, the workpiece while being punched is held securely in position by the pads 31, 4, and hence can be punched reliably to a nicety. The shifting cam mechanism shown in FIG. 6 is also safe in operation since there is no tendency for the workpiece to jump or spring up under repulsive forces after the punching operation.

Although certain preferred embodiments have been shown and described, it should be understood that many changes and modifications may be made therein without departing from the scope of the appended claims.

What is claimed is:

1. A shifting cam mechanism in a press for presswork-ing a workpiece having a depressed portion, comprising:

a pair of top and bottom forms, said top form being movable toward and away from said bottom form;

a die;

a first single cam mechanism disposed between said top and bottom forms for retracting said die from the workpiece, said first single cam mechanism being composed of a pad positioned downwardly of said top form, a lost-motion connection between said pad and said top form, a pin mounted on and extending downwardly from said pad, a first cam follower mounted on said bottom form and movable in response to depression of said pin, and a second cam follower mounted on said bottom form in abutment with said first cam follower and having said die mounted thereon, said second cam follower being movable in a direction to retract said die by a distance equal to the depressed portion of the workpiece when said first cam followr is moved on release of said pin;

a punch;

a resilient compressible support between said pad and said top form, said support being compressible upon movement of said forms towards each other to permit abutment of said top form against said pad while actuating said cam mechanism to move said die towards the workpiece; and a second single cam mechanism disposed between said top and bottom forms for moving said punch to punch the depressed portion of the workpiece, said second single cam mechanism being composed of a fixed cam mounted on said top form, and a third cam follower mounted on said bottom form and supporting said punch, said third cam follower being in abutment with said fixed cam to move in response to depression of said fixed cam for enabling said punch to punch the depressed portion of the workpiece in coaction with said die on said second cam follower.

2. A shifting cam mechanism according to claim 1 wherein said lost-motion connection comprises a pin received in a slot with a clearance.

3. A shifting cam mechanism according to claim 1 wherein said support is made of urethane resin.

4. a shifting cam mechanism according to claim 1, including springs normally urging said first, second and third cam followers in directions opposite to the directions in which they are moved on working the workpiece.

5. A shifting cam mechanism according to claim 1, including an elastic pad disposed around said punch.

6. A method of shifting cam mechanism in a press, comprising the steps:

lowering a top form toward a bottom form;

lowering a pin toward a first cam follower through a pad in response to the lowering movement of said top form to move said cam follower while compressing a resilient compressible support between said forms:

moving a second cam follower having a die in a direction toward a workpiece in response to the lowering movement of said first cam follower;

moving a third cam follower having a punch in a direction toward the workpiece through a fixed cam on said top form in response to the lowering movement of the latter;

returning said third cam follower to an initial position thereof away from the workpiece in response to upward movement of said top form away from said bottom form while returning said support to an initial position thereof; and returning said pad, said pin, said first and second cam folowers to initial positions thereof in response to the upward movement of said top form slightly after said third cam follower has started returning to its initial position.

7. In combination, a press having a top form and a bottom form movable vertically towards and away from each other;

a die between said forms for engaging a workpiece;

a punch for working an engaged workpiece on said die;

a first cam mechanism between said forms for moving said die between a working position and a retracted position, said mechanism including a vertically movable pad below and spaced from said top form, a pin extending vertically from said pad, a first cam follower below said pin for vertical movement therewith, a second cam follower mounted on said bottom form in abutment with said first cam follower and mounting said die thereon, a first spring biasing said first cam follower towards said pin and a second spring biasing said secnd cam follower against said first cam follower, a lost-motion connection betweeen said pad and said top form, and a resilient compressible support between said pad and said top form, said support being compressible upon movement of said forms towards each other to permit abutment of said top form against said pad while actuating said cam mechanism to move said die to said working position and after an initial movement of said forms away from each other to permit said cam mechanism to move said die a predetermined distance to said retracted position; and a second cam mechanism between said forms for moving said punch between a working position and a retracted position, said second cam mechanism including a fixed cam mounted on said top form, a third follower in abutment with said cam and secured to said punch for moving said punch to said working position thereof in rsponse to said forms moving towards each other and a third spring for moving said third cam follower to return said punch to said retracted position thereof in response to said forms moving away from each other.

8. The combination as set forth in claim 7 which further comprises an elastic pad around said punch.

* * * * *